US009080798B2

(12) United States Patent
Shapiro et al.

(10) Patent No.: US 9,080,798 B2
(45) Date of Patent: Jul. 14, 2015

(54) CONTROL METHOD FOR MODULAR REFRIGERATED MERCHANDISER

(71) Applicant: Hussmann Corporation, Bridgeton, MO (US)

(72) Inventors: Doron Shapiro, St. Louis, MO (US); Timothy D. Anderson, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 428 days.

(21) Appl. No.: 13/671,140

(22) Filed: Nov. 7, 2012

(65) Prior Publication Data

US 2014/0123691 A1 May 8, 2014

(51) Int. Cl.

*F25B 49/00* (2006.01)
*F25B 49/02* (2006.01)
*F25D 29/00* (2006.01)

(52) U.S. Cl.

CPC ..... *F25B 49/022* (2013.01); *F25D 29/00* (2013.01); *F25B 2400/06* (2013.01); *F25B 2600/0251* (2013.01); *F25D 2700/12* (2013.01)

(58) Field of Classification Search

CPC ..... F25B 49/022; F25B 2400/06; F25B 2600/02; F25B 2600/022; F25B 2600/0251; F25D 29/00; F25D 2600/02; F25D 2700/12
USPC ..... 62/175, 228.1, 228.5, 229
See application file for complete search history.

(56) References Cited

U.S. PATENT DOCUMENTS 4,152,902 A 5/1979 Lush
4,614,089 A 9/1986 Dorsey
4,748,820 A 6/1988 Shaw
5,065,591 A 11/1991 Shaw
5,123,256 A 6/1992 Oltman
5,231,846 A 8/1993 Goshaw et al.
5,343,384 A 8/1994 Fisher et al.
5,586,444 A 12/1996 Fung
5,743,098 A * 4/1998 Behr ..... 62/80
6,233,954 B1 5/2001 Mehaffey et al.
6,568,197 B2 5/2003 Uno et al.
6,705,097 B2 3/2004 So et al.
7,159,413 B2 1/2007 Dail
7,540,164 B2 6/2009 Roche et al.
7,555,913 B2 7/2009 Hwang et al.
7,617,695 B2 11/2009 Shapiro
7,793,509 B2 9/2010 Crane
8,020,391 B2 9/2011 Swofford et al.

(Continued)

*Primary Examiner* — Marc Norman

(74) *Attorney, Agent, or Firm* — Michael Best & Friedrich LLP

(57) ABSTRACT

A method of controlling a refrigerated merchandiser including a plurality of display case modules each having a separate refrigeration circuit with a compressor and an evaporator. The method includes selectively starting and stopping a first compressor of a first refrigeration circuit having a first evaporator associated with a first display case module to regulate a temperature in a product display area of the first display case module, and selectively starting and stopping a second compressor of a second refrigeration circuit having a second evaporator associated with a second display case module to regulate a temperature in a product display area of the second display case module. The method also includes controlling the first refrigeration module and the second refrigeration module based on a heat load of the merchandiser and a predetermined number of start/stop cycles of each of the first compressor and the second compressor within a given time period.

20 Claims, 6 Drawing Sheets

(56) References Cited

U.S. PATENT DOCUMENTS

| | | | | |
|---|---|---|---|---|
| 2004/0031280 | A1 | 2/2004 | Martin et al. | |
| 2004/0261429 | A1 * | 12/2004 | Dobmeier et al. | 62/90 |
| 2005/0126193 | A1 * | 6/2005 | Lifson et al. | 62/175 |
| 2005/0126196 | A1 | 6/2005 | Grassmuck et al. | |
| 2006/0201175 | A1 | 9/2006 | Shapiro et al. | |
| 2008/0148751 | A1 | 6/2008 | Swofford | |
| 2011/0265507 | A1 | 11/2011 | Zangari et al. | |

* cited by examiner

| 100% LOAD | | | |
|---|---|---|---|
| | COMP1 | COMP2 | COMP3 |
| MINUTES | | | |
| 1 | ON | ON | ON |
| 2 | ON | ON | ON |
| 3 | ON | ON | ON |
| 4 | ON | ON | ON |
| 5 | ON | ON | ON |
| 6 | ON | ON | ON |
| 7 | ON | ON | ON |
| 8 | ON | ON | ON |
| 9 | ON | ON | ON |
| 10 | ON | ON | ON |
| 11 | ON | ON | ON |
| 12 | ON | ON | ON |

*FIG. 5a*

| 92% LOAD | | | |
|---|---|---|---|
| | COMP1 | COMP2 | COMP3 |
| MINUTES | | | |
| 1 | **OFF** | ON | ON |
| 2 | ON | ON | ON |
| 3 | ON | ON | ON |
| 4 | ON | ON | ON |
| 5 | ON | **OFF** | ON |
| 6 | ON | ON | ON |
| 7 | ON | ON | ON |
| 8 | ON | ON | ON |
| 9 | ON | ON | **OFF** |
| 10 | ON | ON | ON |
| 11 | ON | ON | ON |
| 12 | ON | ON | ON |

*FIG. 5b*

| 83% LOAD | | | |
|---|---|---|---|
| | COMP1 | COMP2 | COMP3 |
| MINUTES | | | |
| 1 | **OFF** | ON | ON |
| 2 | ON | ON | ON |
| 3 | ON | **OFF** | ON |
| 4 | ON | ON | ON |
| 5 | ON | ON | **OFF** |
| 6 | ON | ON | ON |
| 7 | **OFF** | ON | ON |
| 8 | ON | ON | ON |
| 9 | ON | **OFF** | ON |
| 10 | ON | ON | ON |
| 11 | ON | ON | **OFF** |
| 12 | ON | ON | ON |

*FIG. 5c*

| 66% LOAD | | | |
|---|---|---|---|
| | COMP1 | COMP2 | COMP3 |
| MINUTES | | | |
| 1 | **OFF** | ON | ON |
| 2 | **OFF** | ON | ON |
| 3 | ON | **OFF** | ON |
| 4 | ON | **OFF** | ON |
| 5 | ON | ON | **OFF** |
| 6 | ON | ON | **OFF** |
| 7 | **OFF** | ON | ON |
| 8 | **OFF** | ON | ON |
| 9 | ON | **OFF** | ON |
| 10 | ON | **OFF** | ON |
| 11 | ON | ON | **OFF** |
| 12 | ON | ON | **OFF** |

*FIG. 5d*

| 89% LOAD | | | |
|---|---|---|---|
| | COMP1 | COMP2 | COMP3 |
| MINUTES | | | |
| 1 | ON | **OFF** | ON |
| 2 | ON | ON | ON |
| 3 | ON | ON | ON |
| 4 | ON | ON | ON |
| 5 | ON | ON | ON |
| 6 | ON | **OFF** | ON |
| 7 | ON | **OFF** | ON |
| 8 | ON | ON | ON |
| 9 | ON | ON | ON |
| 10 | ON | ON | ON |
| 11 | ON | ON | ON |
| 12 | ON | **OFF** | ON |

*FIG. 6a*

| 75% LOAD | | | |
|---|---|---|---|
| | COMP1 | COMP2 | COMP3 |
| MINUTES | | | |
| 1 | ON | **OFF** | ON |
| 2 | ON | **OFF** | ON |
| 3 | ON | **OFF** | ON |
| 4 | ON | ON | ON |
| 5 | ON | **OFF** | ON |
| 6 | ON | **OFF** | ON |
| 7 | ON | **OFF** | ON |
| 8 | ON | ON | ON |
| 9 | ON | ON | ON |
| 10 | ON | **OFF** | ON |
| 11 | ON | **OFF** | ON |
| 12 | ON | **OFF** | ON |

*FIG. 6b*

| 66% LOAD | | | |
|---|---|---|---|
| | COMP1 | COMP2 | COMP3 |
| MINUTES | | | |
| 1 | ON | **OFF** | ON |
| 2 | ON | **OFF** | ON |
| 3 | ON | **OFF** | ON |
| 4 | ON | **OFF** | ON |
| 5 | ON | **OFF** | ON |
| 6 | ON | **OFF** | ON |
| 7 | ON | **OFF** | ON |
| 8 | ON | **OFF** | ON |
| 9 | ON | **OFF** | ON |
| 10 | ON | **OFF** | ON |
| 11 | ON | **OFF** | ON |
| 12 | ON | **OFF** | ON |

*FIG. 6c*

CONTROL METHOD FOR MODULAR REFRIGERATED MERCHANDISER

BACKGROUND

The present invention relates to a control method for a refrigerated merchandiser. More specifically, the invention relates to a modular refrigerated display case.

Refrigerated merchandisers are used by grocers to store and display food items in a product display area that must be kept within a predetermined temperature range. These merchandisers generally include a case that is conditioned by a refrigeration system that has a compressor, a condenser, and at least one evaporator connected in series with each other. For open and closed merchandisers that have modular sections, the air temperature among the product display sections can fluctuate significantly. These temperature fluctuations can damage food product supported in the case.

SUMMARY

In one construction, the invention provides a method of controlling a refrigerated merchandiser including a plurality of display case modules each having a separate refrigeration circuit with a compressor and an evaporator. The method includes selectively starting and stopping a first compressor of a first refrigeration circuit having a first evaporator associated with a first display case module to regulate a temperature in a product display area of the first display case module, and selectively starting and stopping a second compressor of a second refrigeration circuit having a second evaporator associated with a second display case module to regulate a temperature in a product display area of the second display case module. The method also includes controlling the first refrigeration module and the second refrigeration module based on a heat load of the merchandiser and a predetermined number of start/stop cycles of each of the first compressor and the second compressor within a given time period.

In another construction, the invention provides a method of controlling a refrigerated merchandiser including a plurality of display case modules each having a separate refrigeration circuit with a compressor and an evaporator. The method includes determining a temperature associated with a first product display area of a first display case module, selectively starting and stopping a first compressor of a first refrigeration circuit having a first evaporator associated with the first display case module to regulate the temperature associated with the first product display area, determining a temperature associated with a second product display area of a second display case module, and selectively starting and stopping a second compressor of a second refrigeration circuit having a second evaporator associated with the second display case module to regulate the temperature associated with the second product display area. The method also includes weighting a run time of one of the first compressor and the second compressor for a predetermined time interval based on the time-averaged temperatures of the first and second product display areas, and evenly regulating the temperatures of the first and second product display areas.

In another construction, the invention provides a method of controlling a refrigerated merchandiser including a plurality of display case modules each having a separate refrigeration circuit with a compressor and an evaporator. The method includes determining a temperature associated with a first product display area of a first display case module, selectively starting and stopping a first compressor of a first refrigeration circuit having a first evaporator associated with the first display case module to regulate the temperature associated with the first product display area, determining a temperature associated with a second product display area of a second display case module, and selectively starting and stopping a second compressor of a second refrigeration circuit having a second evaporator associated with the second display case module to regulate the temperature associated with the second product display area. The method also includes selectively weighting a run time of one of the first compressor and the second compressor for a predetermined time interval based on the time-averaged temperature of the first product display area and the time-averaged temperature of the second product display area, evenly regulating the temperatures of the first and second product display areas, and controlling the first refrigeration circuit and the second refrigeration circuit based on a heat load of the merchandiser and a predetermined number of start/stop cycles of each of the first compressor and the second compressor within a given time period.

Other aspects of the invention will become apparent by consideration of the detailed description and accompanying drawings.

BRIEF DESCRIPTION OF THE DRAWINGS

FIG. 5*a* is a table illustrating compressor operation for the refrigerated merchandiser of FIG. 1 at 100% heat load.

FIG. 5*b* is a table illustrating compressor operation at 92% heat load in response to the display case modules having uniform time-averaged air temperatures.

FIG. 5*c* is a table illustrating compressor operation at 83% heat load in response to the display case modules having uniform time-averaged air temperatures.

FIG. 5*d* is a table illustrating compressor operation at 66% heat load in response to the display case modules having uniform time-averaged air temperatures.

FIG. 6*a* is a table illustrating compressor operation for the refrigerated merchandiser of FIG. 1 at 89% heat load in response to one of the display case modules having a colder time-averaged air temperature than the remaining display case modules.

FIG. 6*b* is a table illustrating compressor operation at 75% heat load in response to one of the display case modules having a colder time-averaged air temperature than the remaining display case modules.

FIG. 6*c* is a table illustrating compressor operation at 66% heat load in response to one of the display case modules having a colder time-averaged air temperature than the remaining display case modules.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
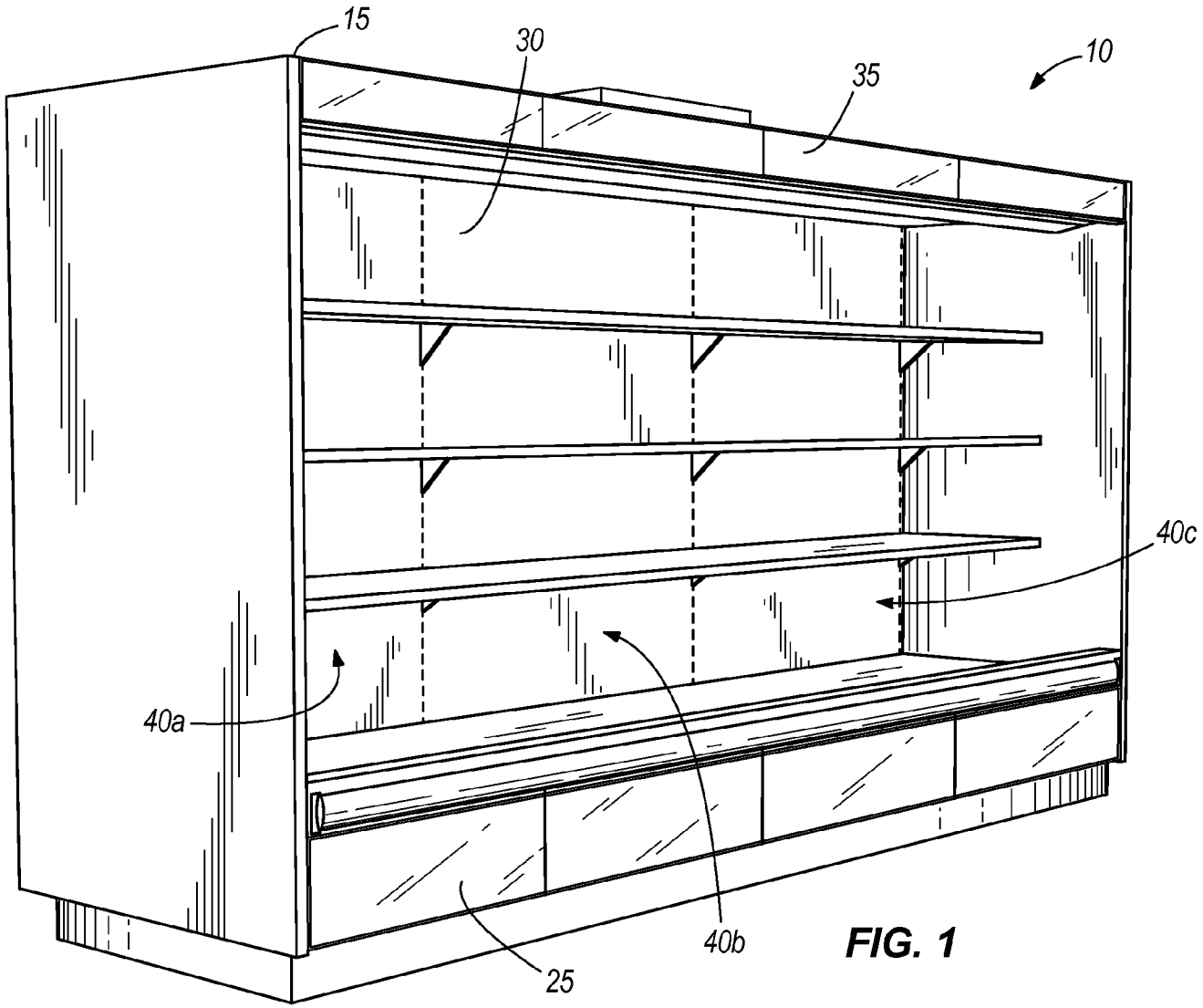
FIG. 1 is a perspective view of a refrigerated merchandiser including a plurality of display case modules.

FIG. 1 shows one construction of a refrigerated merchandiser 10 that may be located in a supermarket or a convenience store (not shown) for presenting fresh food, beverages, and other food product (not shown) to consumers. As illustrated, the merchandiser 10 is a self-contained merchandiser 10 with an open front, although the merchandiser 10 can take other forms (e.g., single or multi-deck merchandisers, merchandisers with doors positioned over the open front, etc.).

Figure 2:
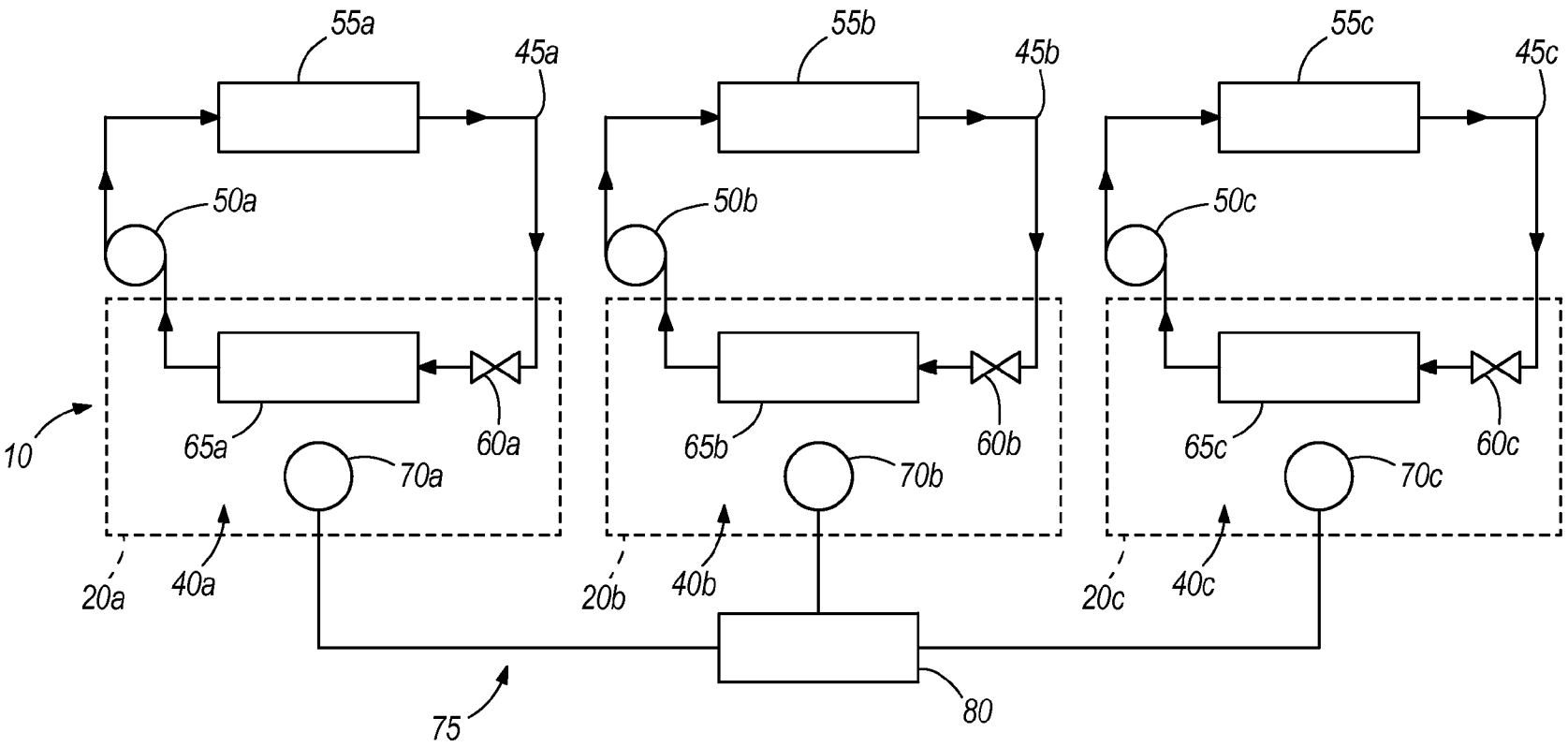
FIG. 2 is a schematic of the refrigerated merchandiser of FIG. 1 illustrating the display case modules each having a separate refrigeration circuit.
Figure 3:
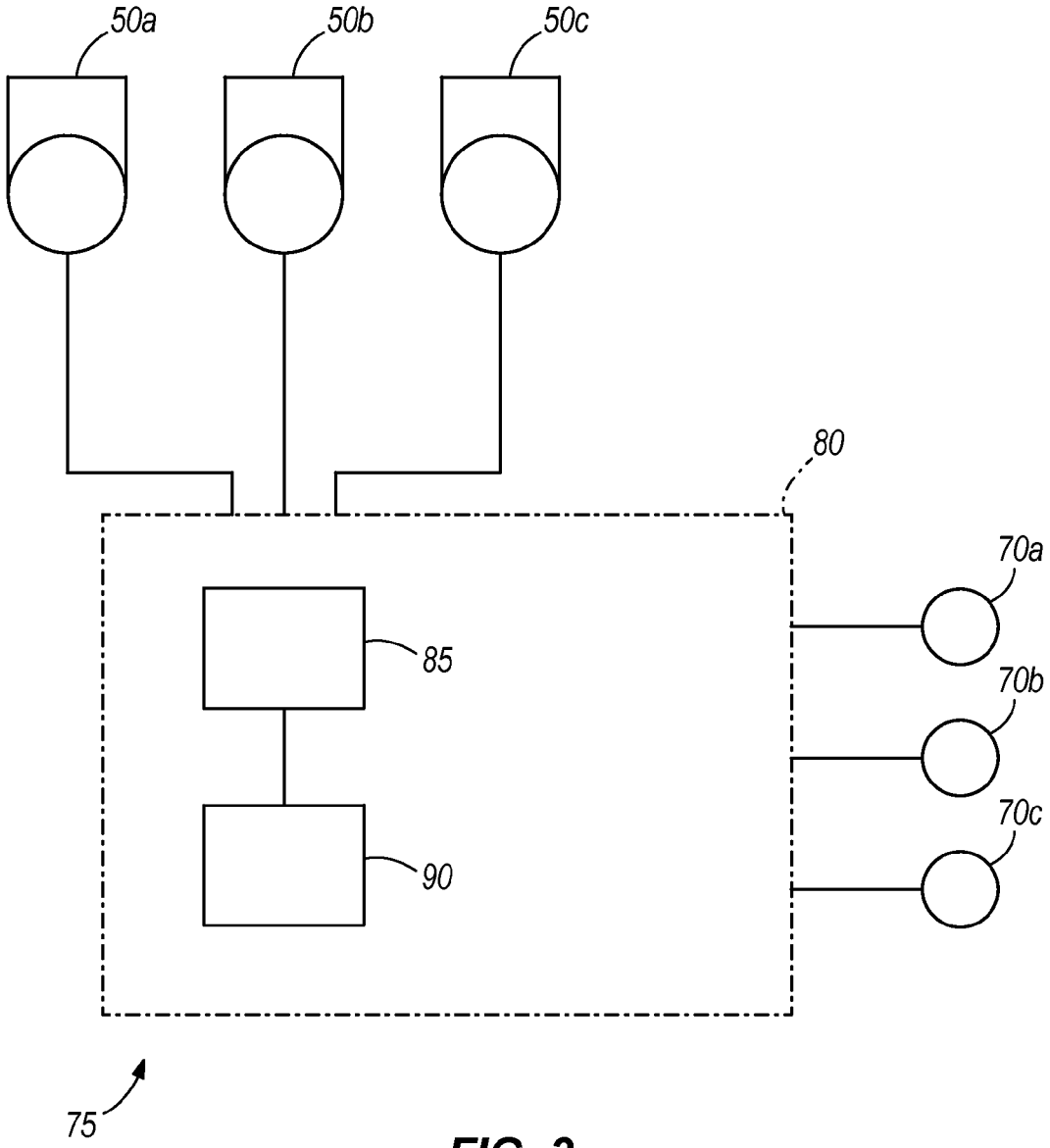
FIG. 3 is a schematic of a portion of a control system of the refrigerated merchandiser of FIG. 1.

With reference to FIGS. 1-3, the merchandiser 10 includes a case 15 that has a plurality of display case modules 20 each defining a portion of a base 25, a rear wall 30, and a canopy 35 of the merchandiser 10. The illustrated merchandiser 10 has three display case modules 20*a-c* (e.g., three 4-foot modular sections), although the merchandiser 10 can include fewer or more than three display case modules 20. Each display case module 20*a-c* defines a product display area 40*a-c* of the merchandiser 10. The product display areas 40*a-c* support food product and are accessible by customers through the open front of the case 15.

The merchandiser 10 has a heat load that correlates to the amount of heat that needs to be extracted from the product display areas 40 to maintain food product within a predetermined temperature range (e.g., 33-41° Fahrenheit). Generally, the merchandiser heat load is impacted by and will change depending on heat of food product and case structure in the product display area 40, and heat introduced from the surrounding environment. Other factors may also affect the merchandiser heat load.

Referring to FIG. 2, each illustrated display case module 20 is identical or nearly identical and includes a separate refrigeration circuit 45 in communication with the merchandiser 10 to condition the associated product display area 40 based on the merchandiser heat load. The refrigeration circuits 45 are designed to accommodate the maximum heat load (i.e., 100% heat load) of the merchandiser 10.

Each refrigeration circuit 45 has a compressor 50 (e.g., one compressor or several compressors 50 in an assembly), a gas cooler or condenser 55, an expansion valve 60, and an evaporator 65 fluidly coupled in series with each other. Each compressor 50 has a run time that increments whenever the compressor 50 is in an on state. Generally, each compressor 50 is cycled to an off state when the temperature in the associated product display area 40 is below a predetermined temperature range. Also, each compressor 50 has a predetermined number of start/stop cycles (e.g., 6 starts and stops of a compressor) that are allowed or permitted (e.g., by a manufacturer) within a given time period (e.g., one hour) to limit wear and tear on the compressor 50. The predetermined number of start/stop cycles can be determined by the permitted or allowed start/stop cycles for each compressor 50 based on manufacturer recommendations, or by other factors. The illustrated compressors 50 are fixed-speed compressors that are placed remote from the merchandiser 10, although the compressors 50 can take other forms and can be positioned in or adjacent the merchandiser 10, if desired.

As is known in the art, the evaporator 65 is fluidly coupled with the compressor 50 via a suction line to deliver evaporated refrigerant from the evaporator 65 to the compressor 50, and is fluidly coupled with the condenser 55 via the expansion valve 60 and an inlet line to receive cooled, condensed refrigerant from the condenser 55. Each evaporator 65 is in communication with air flowing within an air passageway (not shown) that extends through the associated display case module 20 so that the airflow is refrigerated by heat transfer with refrigerant in the evaporator 65. The conditioned airflow is directed toward the product display area 40 (e.g., typically in the form of an air curtain through the canopy 35, etc.) to maintain food product in the product display area 40 within the predetermined temperature range by removing the heat load. Although not shown, each refrigeration circuit 45 can include other components based on the desired characteristics for the merchandiser 10.

FIGS. 2 and 3 show that the merchandiser 10 also includes sensors 70*a-c* in communication with each of the product display areas 40*a-c*, and a control system 75 that has a controller 80 in communication (e.g., wired or wireless) with the compressors 50 and the sensors 70*a-c*. Each sensor 70 senses a temperature of the associated product display area 40 and delivers a signal indicative of that temperature to the controller 80. By way of example only, the sensors 70*a-c* can detect a discharge air temperature associated with each display case module 20, or the sensors 70*a-c* can sense the temperature of air within the product display areas 40*a-c* (e.g., product simulators that simulate product temperatures in the display case modules 20). The temperatures detected by the sensors 70*a-c* are defined as control temperatures by which the conditions of the product display areas 40*a-c* can be controlled. In some constructions, the merchandiser 10 may include one or more additional sensors (not shown) to sense various conditions of the refrigerated merchandiser 10 and/or the surrounding environment.

With continued reference to FIGS. 2 and 3, the controller 80 includes a microprocessor 85 that executes and processes controls of the controller 80, and a memory 90 that stores information associated with control and operation of the merchandiser 10. For example, the memory 90 can store data related to operation and diagnostics associated with the compressors 50*a-c*, as well as other components of the refrigeration circuits 45*a-c* and of the merchandiser 10 more generally.

In operation, the controller 80 controls operation of the compressors 50*a-c* and the evaporators 65*a-c* to regulate the temperatures in the product display areas 40*a-c* so that these temperatures are uniform or consistent with each other. Stated another way, it is desired to have the time-averaged temperature in each product display area 40 be substantially equal to each other so that food product in all the display case modules 20 is maintained within the predetermined temperature range. To accomplish this, the controller 80 selectively starts and stops each compressor 50 to regulate the temperature of the associated product display area 40.

In general, when the product display temperature drops below the predetermined temperature range, the controller 80 cycles the associated compressor 50 to the off state so that refrigeration of the air flowing through the display case module 20 is substantially suspended. As a result, the temperature in the product display area 40 slowly increases to within the predetermined temperature range. The controller 80 then starts the compressor 50 when additional refrigeration is needed to maintain the temperature of the product display area 40 within the predetermined temperature range.

The controller 80 uses the signals from the sensors 70*a-c* to determine the temperatures of the first, second, and third product display areas 40*a-c*, and over time, the controller 80 determines the time-averaged temperature for each product display area 40. The controller 80 also manages the refrigeration circuits 45*a-c* to control the run time the compressors 50*a-c* based on the time-averaged temperatures of the product display areas 40*a-c*, and to control the number of start/stop cycles of each compressor 50 within the given time period.

Figure 4:
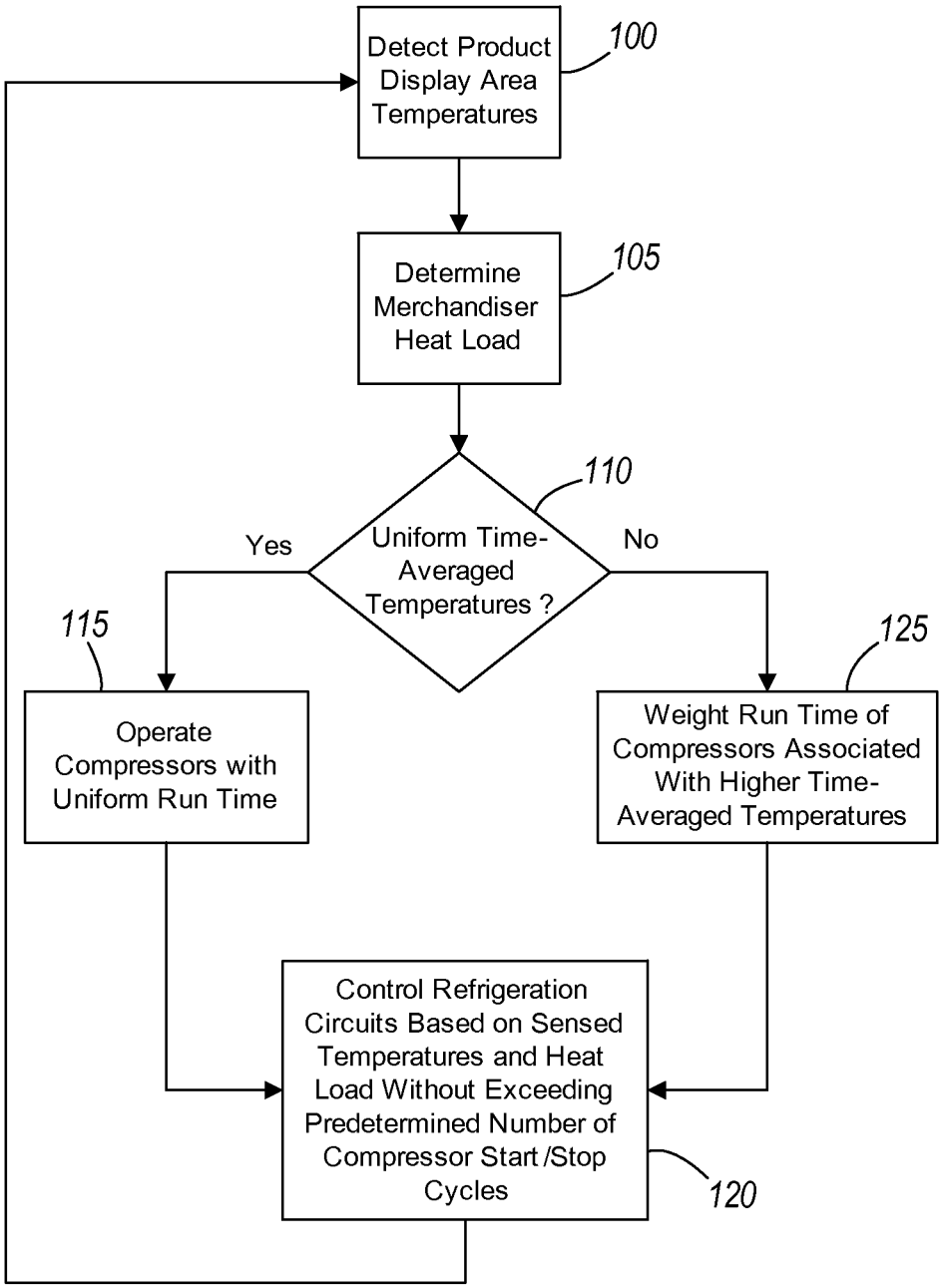
FIG. 4 illustrates a flow chart of a control process for controlling the merchandiser of FIG. 1.

FIG. 4 illustrates an exemplary control process for the merchandiser 10. At step 100, the controller 80 detects the temperatures of the product display areas 40*a-c*. At step 105, the controller 80 determines the heat load of the merchandiser 10. At step 110, the controller 80 determines the time-averaged temperature of each product display area 40 based on the current sensed temperature and historical sensed temperatures stored in the memory 90. If the time-averaged temperatures of the product display areas 40*a-c* are uniform (i.e., "Yes" at step 110), the control process continues to step 115. At step 115, the controller 80 manages the refrigeration circuits 45*a-c* so that the compressors 50*a-c* among the refrigeration circuits 45*a-c* have approximately the same run time. The control process then proceeds to step 120, at which the controller 80 controls the refrigeration circuits 45*a-c* and regulates the product display area temperatures based on the sensed temperatures and the merchandiser heat load without exceeding the predetermined number of compressor start/stop cycles.

In some circumstances, one product display area 40 can have a time-averaged temperature that is colder than adjacent product display areas 40. Referring back to step 110, if the time-averaged temperatures of the product display areas 40*a-c* are not uniform (i.e., "No" at step 110), the control process continues to step 125. At step 125, the controller 80 manages the refrigeration circuits 45*a-c* so that one or more of the compressors 50*a-c* among the refrigeration circuits 45*a-c* are weighted to have a longer run time than at least one other compressor 50. The time-averaged temperature of the colder product display area 40 eventually increases over time to match the time-averaged temperature of the other product display areas 40 because the associated compressor is off more frequently than the other compressors 50. Mixing or co-mingling of air in the merchandiser 10 over time also helps to return all of the time-average temperatures to a state of uniformity. The control process then proceeds to step 120, at which the controller 80 controls the refrigeration circuits 45*a-c*, taking into account whether the time-averaged temperature of one or more product display areas 40*a-c* is colder than the other temperatures. The controller 80 also regulates the product display area temperatures based on the sensed temperatures and the merchandiser heat load without exceeding the predetermined number of compressor start/stop cycles.

FIGS. 5*a-d* illustrate more specific examples of control of the merchandiser 10 when the time-averaged temperatures of the product display areas 40*a-c* are substantially equal or uniform. Based on the heat load of the merchandiser 10, the controller 80 selectively starts or stops one or more of the compressors 50*a-c* to accommodate the heat load and maintain the temperatures within the predetermined temperature range without exceeding the maximum number of start/stop cycles for each compressor 50. Although FIGS. 5*a-d* illustrate merchandiser control over a twelve minute time period, which corresponds to one cycle of an exemplary control process for the merchandiser 10, the control process for the merchandiser 10 described herein can be longer or shorter than twelve minutes. Also, the time period illustrated in FIGS. 5*a-d* can be the same or different from the given time period described with regard to the start/stop cycles for the compressors 50.

As illustrated in FIG. 5*a*, the heat load of the merchandiser 10 is 100% and all three compressors 50*a-c* are in the on state to accommodate the merchandiser heat load. That is, none of the compressors 50*a-c* are cycled to the off state when the heat load is 100% because the maximum cooling capacity of the refrigeration circuits 45*a-c* is needed to adequately condition the product display areas 40*a-c*.

FIG. 5*b* illustrates control of the merchandiser 10 when the merchandiser heat load is 92% of the maximum load and the time-averaged temperatures of the three product display areas 40*a-c* are uniform. The controller 80 manages the refrigeration circuits 45*a-c* based on the merchandiser heat load by selectively and sequentially stopping each compressor 50 of the three refrigeration circuits 45*a-c* for a predetermined time. Because the time-averaged temperatures are uniform among the product display areas 40*a-c*, each compressor 50 has approximately the same run time for the entire time period. The controller 80 also limits the number of start/stop cycles for each compressor 50 so that the predetermined number of start/stop cycles is not exceeded by any compressor 50 within the given time period. As illustrated, the controller 80 stops each compressor 50 once (e.g., for one minute) during the control cycle to adjust the refrigeration output based on the heat load being lower than the maximum heat load. The illustrated cyclic control of the compressors 50*a-c* is patterned so that all three compressors 50*a-c* are in the on state for three minutes after one of the compressors 50*a-c* is cycled to the off state and before the next compressor 50 is cycled to the off state. In other constructions, cyclic control of the compressors 50*a-c* can be patterned differently or made random.

FIG. 5*c* illustrates control of the merchandiser 10 when the merchandiser heat load is 83% of the maximum load and the time-averaged temperatures of the three product display areas 40*a-c* are uniform. The controller 80 manages the refrigeration circuits 45*a-c* based on the merchandiser heat load by selectively and sequentially stopping each compressor 50 of the three refrigeration circuits 45*a-c* for a predetermined time. Because the time-averaged temperatures are uniform among the product display areas 40, each compressor 50 has approximately the same run time for the entire time period. The controller 80 also limits the number of start/stop cycles for each compressor 50 so that the predetermined number of start/stop cycles is not exceeded by any compressor 50 within the given time period. As illustrated, the controller 80 stops each compressor 50 twice (e.g., for one minute each time) during the control cycle to adjust the refrigeration output based on the heat load being lower than the maximum heat load. The illustrated cyclic control of the compressors 50*a-c* is patterned so that all three compressors 50*a-c* are in the on state for one minute after one of the compressors 50 is cycled to the off state and before the next compressor 50 is cycled to the off state. In other constructions, the cyclic control of the compressors 50*a-c* can be patterned differently or made random.

FIG. 5*d* illustrates control of the merchandiser 10 when the merchandiser heat load is 66% of the maximum load and the time-averaged temperatures of the three product display areas 40 are uniform. The controller 80 manages the refrigeration circuits 45*a-c* based on the merchandiser heat load by selectively and sequentially stopping each compressor 50 of the three refrigeration circuits 45*a-c* for a predetermined time. Because the time-averaged temperatures are uniform among the product display areas 40, each compressor 50 has approximately the same run time for the entire time period. The controller 80 also limits the number of start/stop cycles for each compressor 50 so that the predetermined number of start/stop cycles is not exceeded by any compressor 50 within the given time period. As illustrated, the controller 80 stops each compressor 50 for once (e.g., for two minutes) during the cycle to adjust the refrigeration output based on the heat load being lower than the maximum heat load. The illustrated cyclic control of the compressors 50*a-c* is patterned so that only two compressors 50 are in the on state at the same time. In other constructions, the cyclic control of the compressors 50*a-c* can be patterned differently or made random.

FIGS. 6*a-c* illustrate more specific examples of control of the merchandiser 10 when the time-averaged temperatures across the product display areas 40*a-c* are unequal or non-uniform relative to each other (e.g., none or fewer than all time-averaged temperatures are substantially equal to each other). By way of example only, FIGS. 6*a-c* show control of the refrigeration circuits 45*a-c* based on the time-averaged temperature of the second (e.g., middle) display case module 20*b* being lower than the time-averaged temperatures of the first and third display case modules 20*a, c*. It will be appreciated that control of the merchandiser 10 when one or more time-averaged temperatures is unequal relative to the other time-averaged temperature(s) will be similar to what is described in detail below, regardless of which display case module 20 the non-uniform time-averaged temperature is associated with.

FIG. 6*a* illustrates control of the merchandiser 10 when the merchandiser heat load is 89% of the maximum load and the time-averaged temperature of the second product display area 40*b* is lower than the time-averaged temperatures of the first and third product display areas 40*a, c*. As shown, the controller 80 selectively starts and stops only the second compressor 50*b* to accommodate the merchandiser heat load without exceeding the maximum number of start/stop cycles for the second compressor 50*b*. As a result, the second compressor 50*b* has a run time that is shorter than the run times of the first and third compressors 50*a, c* such that the stop cycles for the control process illustrated in FIG. 6*a* are weighted toward the second compressor 50*b*. Stated another way, the run time of the compressors 50 is weighted toward the first and third compressors 50*a, c* (i.e., weighted toward the compressors 50 associated with the higher time-averaged temperatures) so that the first and third compressors 50*a, c* have a longer run time relative to the second compressor 50*b*.

The second compressor 50*b* is started and stopped several times during the cycle so that the time-averaged temperature of the second product display area 40*b* rises when the second compressor 50*b* is stopped. The controller 80 manages the second refrigeration circuit 45*b* relative to the first and third refrigeration circuits 45*a, c* so that the time-averaged temperatures among the first, second, and third product display areas 40*a-c* eventually return to a state of uniformity. The illustrated cyclic control of the compressors 50*a-c* is patterned so that the second compressor 50*b* is stopped for a period of time (e.g., one or two minutes), and started and operating for a period of time (e.g., four minutes) before the second compressor 50*b* is stopped again. In other constructions, the cyclic control of the compressors 50*a-c* can be patterned differently or made random.

FIG. 6*b* illustrates control of the merchandiser 10 when the merchandiser heat load is 75% of the maximum load and the time-averaged temperature of the second product display area 40*b* is lower than the time-averaged temperatures of the first and third product display areas 40*a, c*. As shown, the controller 80 selectively starts and stops only the second compressor 50*b* to accommodate the merchandiser heat load without exceeding the maximum number of start/stop cycles for the second compressor 50*b*. As a result, the second compressor 50*b* has a run time that is shorter than the run times of the first and third compressors 50*a, c* such that the stop cycles for the control process illustrated in FIG. 6*b* are weighted toward the second compressor 50*b*. Stated another way, the run time of the compressors 50 is weighted toward the first and third compressors 50*a, c* (i.e., weighted toward the compressors 50 associated with the higher time-averaged temperatures) so that the first and third compressors 50*a, c* have a longer run time relative to the second compressor 50*b*. The second compressor 50*b* is started and stopped several times during the cycle so that the time-averaged temperature of the second product display area 40*b* rises relative to the time-averaged temperatures of the product display areas 40*a, c*.

As illustrated, the second compressor 50*b* is stopped for a longer period of time (e.g., three minutes) to accommodate the lower heat load relative to the control process for the merchandiser 10 with an 89% heat load. The control process illustrated in FIG. 6*b* is similar to the control process described with regard to FIG. 6*a* in that the controller 80 manages the second refrigeration circuit 45*b* relative to the first and third refrigeration circuits 45*a, c* so that the time-averaged temperatures among the first, second, and third product display areas 40*a-c* eventually return to a state of uniformity. The illustrated cyclic control of the compressors 50*a-c* is patterned so that the second compressor 50*b* is stopped for a period of time (e.g., three minutes), and started and operating for a period of time (e.g., one or two minutes) before the second compressor 50*b* is stopped again. In other constructions, the cyclic control of the compressors 50*a-c* can be patterned differently or made random.

FIG. 6*c* illustrates control of the merchandiser 10 when the merchandiser heat load is 66% of the maximum load and the time-averaged temperature of the second product display area 40*b* is lower than the time-averaged temperatures of the first and third product display areas 40*a, c*. Generally, the control process of FIG. 6*c* is similar to the control processes described with regard to FIG. 6*a* and FIG. 6*b*. With reference to FIG. 6*c*, the second compressor 50*b* does not operate during the control cycle based on the heat load of the merchandiser 10 and the colder time-averaged temperature of the product display area 40*b* associated with the second compressor 50*b*. Stated another way, only the first and third compressors 50*a, c*, which are associated with the product display areas 40*a, c* that have higher time-averaged temperatures, have a non-zero run time. The controller 80 manages the second refrigeration circuit 45*b* relative to the first and third refrigeration circuits 45*a, c* so that the time-averaged temperatures among the first, second, and third product display areas 40*a-c* eventually return to uniformity.

The controller 80 is in communication with the compressors 50 to selectively start and stop the compressors 50 to regulate the temperatures associated with the product display areas 40 based in part on the temperatures detected by the sensors 70 and the heat load of the merchandiser 10. The controller 80 also accounts for the predetermined number of compressor start/stop cycles that are allowed for each compressor 50 within a given time period (e.g., one hour) so that, when possible, all compressors 50 have the same or substantially the same run time to avoid excessive wear and tear excessive wear and tear on the compressors 50.

As one or both of the heat load and the condensing temperature associated with the merchandiser decrease, the cyclic, sequential control of the compressors 50 in a time proportional manner avoids excessive temperature swings and eliminates the need for speed controls (e.g., inverters) for individual compressors 50. The control system 75 also accounts for situations in which one or more of the display case modules 20 have a time-averaged temperature that is lower than the time-averaged temperatures of the other display case modules 20 by regulating the compressor 50 associated with the display case module 20 with the lower time-averaged temperature. This way, the time-averaged temperatures across all display case modules 20 return to a uniform value within the predetermined temperature range. That is, the control process selectively weights the run time of the compressors 50 over a predetermined time interval based on the time-averaged temperatures and the heat load to more evenly regulate the time-averaged temperatures among the display case modules 20 without wearing out the compressors 50. Moreover, because the control process selectively starts and stops each compressor 50, defrost of each display case module 20 can be accomplished simply by stopping the associated compressor 50 at set times without having to modify the status of the other refrigeration circuits 45.

Various features and advantages of the invention are set forth in the following claims.

What is claimed is:

1. A method of controlling a refrigerated merchandiser including a plurality of display case modules each having a separate refrigeration circuit with a compressor and an evaporator, the method comprising:

selectively starting and stopping a first compressor of a first refrigeration circuit having a first evaporator associated with a first display case module to regulate a temperature in a product display area of the first display case module;

selectively starting and stopping a second compressor of a second refrigeration circuit having a second evaporator associated with a second display case module to regulate a temperature in a product display area of a second display case module; and controlling the first refrigeration circuit and the second refrigeration circuit based on a heat load of the merchandiser and a predetermined number of start/stop cycles of each of the first compressor and the second compressor within a given time period.

2. The method of claim 1, further comprising controlling the first refrigeration circuit and the second refrigeration circuit without exceeding the predetermined number of start/stop cycles of each of the first compressor and the second compressor within the given time period.

3. The method of claim 2, further comprising determining that the product display areas of the first and second display case modules have substantially equal time-averaged temperatures; and controlling the first refrigeration circuit and the second refrigeration circuit so that each of the first compressor and the second compressor have approximately the same run time for a predetermined time interval.

4. The method of claim 1, further comprising stopping the first compressor for a predetermined time in response to a change in the heat load of the merchandiser, the change in heat load defining a second heat load of the merchandiser;

sequentially stopping the second compressor for a predetermined time; and maintaining a consistent temperature among the product display areas of the first display case module and the second display case module based on the second heat load.

5. The method of claim 4, further comprising starting the first compressor before stopping the second compressor.

6. The method of claim 4, further comprising selectively starting and stopping a third compressor of a third refrigeration circuit having a third evaporator associated with a third display case module to regulate a temperature in a product display area of the third display case module based on a refrigeration load of the third display case module; and controlling the first, second, and third refrigeration circuits based on the heat load without exceeding a predetermined number of start/stop cycles each of the first, second, and third compressors within the given time period.

7. The method of claim 6, further comprising determining that the product display areas of the first, second, and third display case modules have substantially equal time-averaged temperatures; and controlling the first refrigeration circuit, the second refrigeration circuit, and the third refrigeration circuit so that each of the first, second, and third compressors has approximately the same run time for a predetermined time interval.

8. The method of claim 7, further comprising sequentially starting and stopping each of the first compressor, the second compressor, and the third compressor based on the second heat load such that at least two of the compressors are operating at the same time.

9. A method of controlling a refrigerated merchandiser including a plurality of display case modules each having a separate refrigeration circuit with a compressor and an evaporator, the method comprising:

determining a temperature associated with a first product display area of a first display case module;

selectively starting and stopping a first compressor of a first refrigeration circuit having a first evaporator associated with the first display case module to regulate the temperature associated with the first product display area;

determining a temperature associated with a second product display area of a second display case module;

selectively starting and stopping a second compressor of a second refrigeration circuit having a second evaporator associated with the second display case module to regulate the temperature associated with the second product display area;

weighting a run time of one of the first compressor and the second compressor for a predetermined time interval based on the time-averaged temperatures of the first and second product display areas; and evenly regulating the temperatures of the first and second product display areas.

10. The method of claim 9, further comprising determining the time-averaged temperature associated with the first product display area is different from the time-averaged temperature associated with the second product display area;

weighting the run time of one of the first compressor and the second compressor to be longer than the run time of the other compressor for the predetermined time interval.

11. The method of claim 10, further comprising controlling the first refrigeration circuit and the second refrigeration circuit based on a heat load of the merchandiser and a predetermined number of start/stop cycles of each of the first compressor and the second compressor within a given time period.

12. The method of claim 11, further comprising controlling the first refrigeration circuit and the second refrigeration circuit without exceeding the predetermined number of start/stop cycles of each of the first compressor and the second compressor within the given time period.

13. The method of claim 9, wherein the merchandiser defines a heat load, the method further comprising stopping the first compressor for a predetermined time in response to a change in the heat load of the merchandiser, the change in heat load defining a second, lower heat load of the merchandiser;

substantially evenly regulating the time-averaged temperatures of the first and second product display areas based on the second heat load.

14. The method of claim 13, further comprising sequentially stopping the second compressor for a predetermined time.

15. The method of claim 9, further comprising determining a temperature associated with a third product display area of a third display case module;

selectively starting and stopping a third compressor of a third refrigeration circuit having a third evaporator associated with a third display case module to regulate the temperature associated with the third product display area;

determining the time-averaged temperature associated with one of the first, second, and third product display areas is colder than the time-averaged temperatures associated with the remaining product display areas; and weighting a run time of the compressor associated with the product display area having the colder time-averaged temperature so that the run time of the associated compressor is shorter than the run time of the other compressors for the predetermined time interval.

16. A method of controlling a refrigerated merchandiser including a plurality of display case modules each having a separate refrigeration circuit with a compressor and an evaporator, the method comprising:

determining a temperature associated with a first product display area of a first display case module;

selectively starting and stopping a first compressor of a first refrigeration circuit having a first evaporator associated with the first display case module to regulate the temperature associated with the first product display area;

determining a temperature associated with a second product display area of a second display case module;

selectively starting and stopping a second compressor of a second refrigeration circuit having a second evaporator associated with the second display case module to regulate the temperature associated with the second product display area;

selectively weighting a run time of one of the first compressor and the second compressor for a predetermined time interval based on the time-averaged temperature of the first product display area and the time-averaged temperature of the second product display area;

evenly regulating the temperatures of the first and second product display areas; and controlling the first refrigeration circuit and the second refrigeration circuit based on a heat load of the merchandiser and a predetermined number of start/stop cycles of each of the first compressor and the second compressor within a given time period.

17. The method of claim 16, further comprising stopping the first compressor for a predetermined time in response to a change in the heat load of the merchandiser, the change in heat load defining a second heat load of the merchandiser;

sequentially stopping the second compressor for a predetermined time; and maintaining consistent time-averaged temperatures across the first and second product display areas based on the second heat load.

18. The method of claim 16, further comprising selectively starting and stopping each of the first compressor and the second compressor without exceeding the predetermined number of start/stop cycles of each of the first and second compressors within the given time period.

19. The method of claim 16, wherein weighting the run time includes operating the first compressor for a shorter total run time than the second compressor for the predetermined time interval in response to the time-averaged temperature of the first product display area being lower than the time-averaged temperature of the second product display area.

20. The method of claim 16, further comprising sequentially stopping the first compressor and the second compressor.

* * * * *